United States Patent [19]

Hutchins

[11] 4,368,921

[45] Jan. 18, 1983

[54] NON-SUBSIDENCE METHOD FOR DEVELOPING AN IN SITU OIL SHALE RETORT

[75] Inventor: Ned M. Hutchins, Grand Junction, Colo.

[73] Assignee: Occidental Oil Shale, Inc., Grand Junction, Colo.

[21] Appl. No.: 239,593

[22] Filed: Mar. 2, 1981

[51] Int. Cl.[3] ..... E21C 41/10

[52] U.S. Cl. ..... 299/2; 299/11; 299/19

[58] Field of Search ..... 299/2, 19, 11

[56] References Cited

U.S. PATENT DOCUMENTS

| | | | |
|---|---|---|---|
| 4,120,355 | 10/1978 | Knepper et al. | 166/259 |
| 4,131,416 | 12/1978 | Watson et al. | 299/2 |
| 4,176,882 | 12/1979 | Studebaker et al. | 299/2 |
| 4,219,237 | 8/1980 | Sisemore | 299/2 |

*Primary Examiner*—Ernest R. Purser

*Attorney, Agent, or Firm*—Christie, Parker & Hale

[57] ABSTRACT

A non-subsidence method for developing an in situ oil shale retort tract in a subterranean formation containing oil shale includes forming a number of spaced apart rows of in situ oil shale retorts, leaving intervening zones of unfragmented formation between adjacent rows of retorts for supporting the overburden loads without substantial subsidence. Each retort contains a fragmented permeable mass of formation particles containing oil shale. The retorts in each row are separated by gas barriers that provide support for the overburden load above each row of retorts. After retorting, a stabilizing material is introduced into the void spaces in the spent in situ oil shale retorts for increasing the compressive strength of the fragmented masses of spent oil shale particles in the spent in situ retorts. Thereafter, separate rows of in situ oil shale retorts are formed in corresponding intervening zones of unfragmented formation. The retorts in each intervening row are separated by gas barriers that provide partial support for the overburden load above each row of intervening retorts. Separate barriers of unfragmented formation are left between the retorts in each intervening row and adjacent rows of spent retorts. This shifts the overburden load to the spent retorts and to the intervening barriers of unfragmented formation, as well as to the barriers of formation between individual retorts in the intervening rows of retorts, which collectively support overburden loads without substantial subsidence during the operating life of the retorts in the intervening rows.

15 Claims, 3 Drawing Figures

NON-SUBSIDENCE METHOD FOR DEVELOPING AN IN SITU OIL SHALE RETORT

BACKGROUND OF THE INVENTION

1. Field of the Invention

This invention relates to in situ recovery of shale oil, and more particularly to techniques for maximizing recovery of shale oil from a system of in situ oil shale retorts formed in a subterranean formation containing oil shale, while supporting overburden loads sufficiently to avoid substantial subsidence during retorting operations in the system of in situ oil shale retorts.

2. Description of the Prior Art

The presence of large deposits of oil shale in the semi-arid high plateau region of the Western United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; 4,043,598; and 4,192,554, which are incorporated herein by this reference. These patents describe in situ recovery of liquid and gaseous hydrocarbon materials from a subterranean formation containing oil shale, wherein such formation is explosively expanded for forming a stationary fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the fragmented mass. In the combustion zone, oxygen from the retort inlet mixture is depleted by reaction with hot carbonaceous material to produce heat, combustion gas and combusted oil shale. By continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable to maximize the amount of oil shale subjected to retorting within a region of formation being developed. To this end it is desirable to minimize the amount of formation excavated from each retort site when forming void volumes in preparation for explosive expansion. The mined out formation is excluded from the in situ retorting process, which can reduce the overall recovery of shale oil from the retorts. Removed formation either must be retorted by above ground techniques, or the shale oil is lost when the mined out material is discarded. Moreover, the steps of mining the shale and transporting it to above ground are expensive and time consuming.

It is also desirable to avoid significant uncontrolled subsidence in a tract of in situ oil shale retorts. There is a trade-off between extracting as much oil shale as possible to maximize resource recovery, and leaving sufficient unrecovered oil shale in the supporing pillars of unfragmented formation for supporting the weight of the overburden to avoid subsidence. Subsidence can result in fracturing of overburden with consequent leakage of water from overlying aquifers into retort or mining areas, leakage of gas from completed retorts, leakage of air into retorts during retorting operations, and safety hazards in underground workings containing operating personnel. Such subsidence can occur when the extraction ratio in the tract is large and the remaining unfragmented formation is not sufficient for supporting the weight of the overburden. For example, a fragmented mass having a substantial void fraction can have a substantially reduced compressive strength as compared with unfragmented formation. Because of the reduced structural support, subsidence of overburden can occur.

Techniques can be devised for developing a tract of in situ oil shale retorts so as to avoid substantial subsidence of overburden during the operating life of the retorts. However, a difficulty with a non-subsiding technique for developing a tract of in situ oil shale retorts is that total resource recovery can be limited, inasmuch as the oil shale that is left in unfragmented formation to support the overburden represents lost production.

Thus, it is desirable to provide a technique for developing a tract of in situ oil shale retorts without significantly uncontrolled subsidence of overburden, but also without leaving substantial proportions of oil shale in unfragmented formation at the end of all retorting operations.

SUMMARY OF THE INVENTION

Briefly, one embodiment of this invention provides techniques for producing reasonably high resource recovery while controlling subsidence of overburden in a system of in situ oil shale retorts. According to these techniques, an intervening zone of unfragmented formation is left between a first spent in situ retort and a second spent in situ retort in which in situ oil shale retorting operatings have been previously conducted. Such a spent in situ oil shale retort contains a fragmented permeable mass of spent oil shale particles. A stabilizing material is introduced into the void spaces of the first and second spent in situ oil shale retorts for increasing the compressive strength of the fragmented masses in the spent in situ retorts sufficiently to support overburden loads. At least one intervening in situ oil shale retort is formed in the intervening zone of unfragmented formation. Such an intervening in situ retort contains a fragmented permeable mass of formation particles containing oil shale. A substantially vertical barrier of unfragmented formation surrounds the intervening in situ retort. The barrier of unfragmented formation is of sufficient thickness to inhibit gas flow from the intervening in situ retort toward adjacent underground workings during retorting operations in the intervening in situ retort. After stabilization of the spent in situ retorts, support of overburden above the intervening in situ retort is shifted to the barrier of unfragmented formation that surrounds the intervening in situ retort, and the fragmented masses within the stabilized spent in situ retorts. Such support is sufficient to avoid subsidence of the overburden during the active life of the intervening in situ retort.

DRAWINGS

These and other aspects of the invention will be more fully understood by referring to the following detailed description and the accompanying drawings, in which:

FIG. 1 is a fragmentary, semi-schematic cross-sectional plan view illustrating an intermediate step in a method of developing an oil shale tract according to principles of this invention, in which spaced apart rows of in situ oil shale retorts are separated by intervening zones of unfragmented formation;

FIG. 2 is a fragmentary, semi-schematic vertical cross-sectional view, taken on line 2—2 of FIG. 1, illustrating in situ oil shale retorts in a pair of adjacent rows separated by an intervening zone of unfragmented formation; and FIG. 3 is a fragmentary, semi-schematic cross-sectional plan view, similar to FIG. 1, showing intervening rows of in situ oil shale retorts formed between rows of previously retorted in situ oil shale retorts.

DETAILED DESCRIPTION

Figure 1:
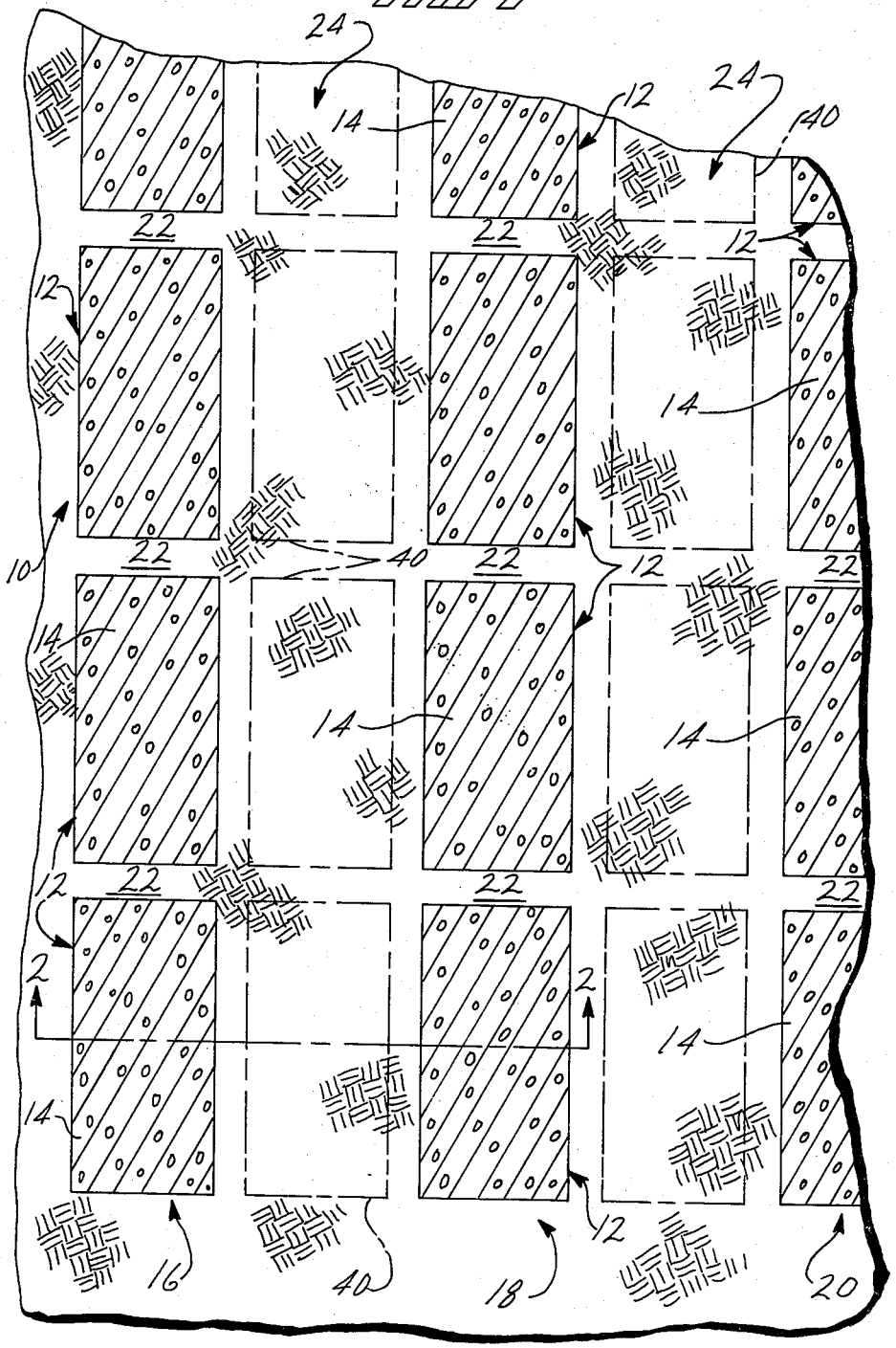

FIG. 1 is a plan view in horizontal cross-section schematically illustrating an arrangement for developing an in situ oil shale retort system in a subterranean formation 10 containing oil shale. The cross-sectional view of FIG. 1 is a small area of an oil shale tract indicating the locations of a first group of in situ oil shale retorts 12 formed in the subterranean formation. Each in situ oil shale retort outlined by solid lines in FIG. 1 represents an individual in situ oil shale retort which, when completed by explosive expansion techniques, comprises a fragmented permeable mass 14 of formation particles containing oil shale, also illustrated in FIG. 2.

In the embodiment illustrated in FIG. 1, the first group of retorts are arranged in an array which includes parallel rows 16, 18, 20, etc., of retorts, also referred to herein as first, second and third rows of retorts. In the illustrated embodiment, the oil shale tract is developed as a "two-pass" retorting system in which the first group of retorts 12 are formed and retorting operations are conducted in the first pass through the oil shale tract, and subsequently a second group of retorts (referred to herein as intervening retorts) are formed and retorting operations are conducted in a second pass through the oil shale tract.

The rows of retorts 12 are horizontally spaced apart substantially equidistantly from one another. The retorts within each row also are horizontally spaced apart substantially equidistantly from one another along the length of the row, leaving vertically extending partitions or gas barriers 22 of unfragmented formation between the ends of adjacent fragmented masses in each row. Intervening zones 24 of unfragmented formation are left between adjacent rows of retorts, such that the intervening zones are interleaved between the rows of retorts in the tract. The intervening zones of unfragmented formation extend parallel to one another and are substantially wider than the narrow partitions or gas barriers that separate the ends of adjacent retorts in each row. The narrow partitions or gas barriers of unfragmented formation separate the fragmented masses within a given row from one another and act as a gas seal for isolating retorting operations in the fragmented masses within each row from one another. The wider intervening zones of unfragmented formation act as gas barriers isolating retorting operations in the retorts in one row from retorting operations in the retorts in adjacent rows. The intervening zones of unfragmented formation also act as long, straight load-supporting barrier pillars for supporting overburden loads above the retorts.

In the illustrated embodiment, the retorts are generally rectangular in horizontal cross-section, and the retorts in each row are arranged so that the long dimensions of the retorts are parallel to, or aligned generally, with the length of the row of retorts. The narrow gas barriers that separate the ends of the retorts extend the short dimension or width of the adjacent retorts. In one embodiment, each retort has a width of about 165 feet, a length of about 380 feet, and a height of about 300 to 400 feet. The partitions of unfragmented formation are, for example, about 50 feet thick. This thickness is sufficiently small to maximize resource recovery while providing barriers that are thick enough to provide adequate gas seals between retorts for isolating retorting reactions in the different retorts from one another. The intervening zones 24 of unfragmented formation are approximately 265 feet wide, i.e., sufficiently wide to provide space for an intervening row of retorts (shown in phantom lines 40 in FIG. 1) with partitions approximately 50 feet thick on opposite sides of the intervening row of retorts. These dimensions are exemplary only and are set forth for the purpose of indicating principles of this invention.

Figure 2:
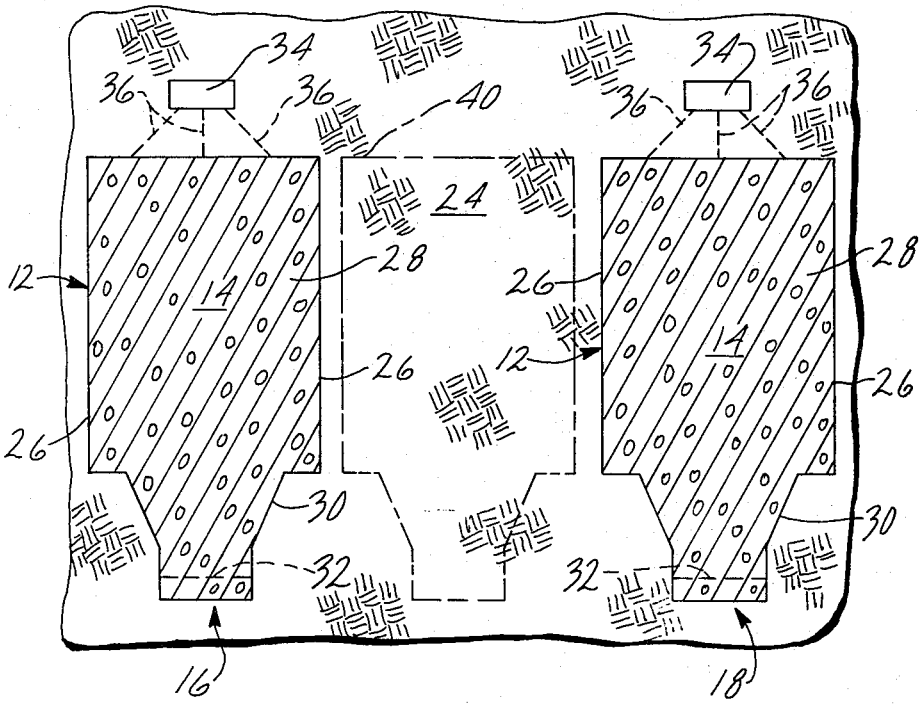

FIG. 2 illustrates schematically, in vertical cross-section, completed in situ oil shale retorts in a pair of adjacent rows 16 and 18 on opposite sides of an intervening zone 24 of unfragmented formation. The fragmented masses 14 within each in situ retort are formed within vertical side boundaries 26 which surround a principal portion 28 of the fragmented mass. A narrower, somewhat funnel-shaped transition zone 30 of each fragmented mass extends downwardly from the principal portion of the fragmented mass to a production level drift 32 below the retort. Each row of retorts has a separate one of these production level drifts extending the length of the row below the retorts in such a row.

The production level drifts are not shown in the plan view of FIG. 1 for simplicity.

A separate air level drift 34 is excavated on an upper working level above each row of retorts. A plurality of feed gas inlet passages 36 are drilled downwardly from the air level drift to the top boundary of each fragmented mass so that oxygen-containing gas can be supplied to each fragmented mass during retorting operations.

The air level drift system and the production level drift system, as well as the configurations of the retorts as illustrated, are exemplary only, since other arrangements can be used without departing from the scope of the invention. For example, a separate gas level drift can be excavated separately from and below the production level drift and isolated from the production level drift, or gas and liquid products can both be recovered in the production level drift only. Other arrangements for transitioning between the lower portion of the fragmented mass and the production level drift also can be used, such as separate bore holes or raises extending between the bottom of the retort and the production level drift. Other air level drift systems also can be used. For example, a separate air level void having approximately the same horizontal cross-section as each retort can be excavated above each retort and used as an upper working level, if desired.

Retorting operations are conducted in the fragmented masses within the retorts 12 in each row within the tract for recovering liquid and gaseous products. Retorting operations can be conducted in any pattern; however, it is desirable to retort several retorts (such as six) in each row as a single module. Groups of retorts in adjacent rows also can be retorted together as a cluster.

During retorting operations, formation particles at the top of each fragmented mass are ignited to establish a combustion zone at the top of such a fragmented mass. Air or other oxygen supplying gas is introduced to the combustion zone from the air level drift 34 through the feed gas inlet passages 36 to the top of the fragmented masses. Combustion gas produced in the combustion zone passes through each fragmented mass to establish a retorting zone on the advancing side of the combustion zone where kerogen in the fragmented mass is converted to liquid and gaseous products. Liquid products, namely, shale oil and water, produced during operation of each retort can be collected in the production level drift along with off gas containing combustion gas. The shale oil, water and off gas can be withdrawn separately from the production level drift and passed to above ground.

The width or narrow dimension of the retorts 12 in each row 16, 18, 20, etc. is sufficiently small that no substantial subsidence of overburden occurs. More specifically, the fragmented masses in each row have reduced compressive strength when compared with unfragmented formation. This reduces the amount of support provided for overburden loads when compared with the same amount of unfragmented formation. The reduced load support provided by the fragmented masses creates a stress field over the fragmented masses. The stress field forms because the load normally supported by unfragmented formation where the fragemented masses now are located is transferred to the intervening zones of unfragmented formation on both sides of each row of fragmented masses. The load transfer creates a "stress arch" in the stress field over the fragmented masses. The stress arch is the neutral axis of the stress field above the fragmented masses, and the neutral axis of the stress field follows a path that generally arches over the fragmented masses, with formation below the neutral axis being in tension, and formation above it being in compression. When formation within the stress field goes into tension, the chances of overburden subsidence can be increased, since the strength of rock in tension is negligible. Moreover, as the width of a given fragmented mass increases, support for overburden loads decreases, which increases the tension in the stress field above the fragmented mass to the point where subsidence of overburden is likely.

In the present method, the retorts in each row 16, 18, 20, etc., are sufficiently narrow in width that the support necessary to avoid undesired subsidence of overburden is maintained. That is, the width or narrow dimension of the rectangular retorts in each row is sufficiently small that formation in the stress field above the fragmented mass remains in compression, with no substantial subsidence or rupture of overburden occurring, while support for the overburden is transferred to the intervening zones of unfragmented formation along both sides of the row of fragmented masses. Thus, by practice of this invention, no substantial load is applied by overburden to the fragmented masses in the retorts.

Support for the overburden is provided principally by the relatively wider intervening zones of unfragmented formation between adjacent rows of retorts, and, in part, by unfragmented formation in the pillars or gas barriers between the ends of the retorts within each row. This combination provides sufficient support for overburden loads that no substantial subsidence occurs at elevations above the retorts during the active life of the retorts.

Figure 3:
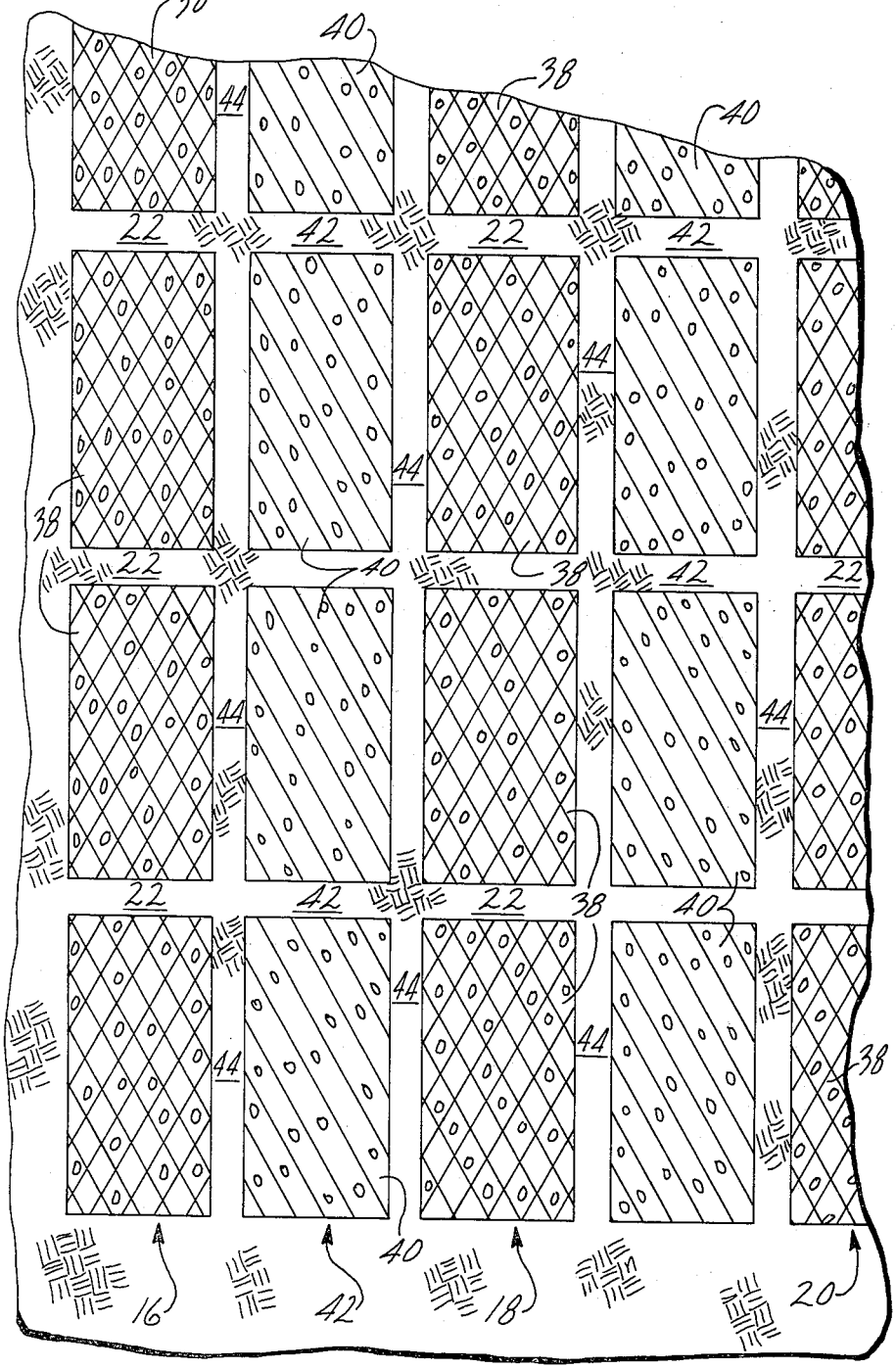

Completion of retorting operations in the fragmented masses 14 leaves rows of spent in situ oil shale retorts 38 in the rows 16, 18, 20, etc., previously occupied by the fragmented masses. The rows of spent in situ oil shale retorts following completion of retorting operations are illustrated schematically in the cross-section view of FIG. 3.

After retorting operations are completed and temperatures in the spent in situ retorts decrease to tolerable levels, further retort development is provided in a second pass through the oil shale tract. Initially in the second pass, the fragmented masses in the spent in situ retorts are stabilized. A stabilizing material is introduced into void spaces in the fragmented masses within the spent in situ oil shale retorts for increasing the compressive strength of each spent in situ retort. Such a stabilizing material can, for example, be finely divided spent oil shale from above-ground retorting re-introduced into the void spaces in each fragmented mass of spent in situ oil shale particles. Such stabilizing material can be introduced as a slurry through the inlet passages 36 leading from the air level void 34 to the tops of the spent in situ retorts; or such stabilizing material can be introduced as described in U.S. Pat. Nos. 4,120,355 to Knepper, 4,131,416 to Watson et al, or 4,219,237 to Sisemore. If desired, a grout for agglutination can be introduced into the void spaces in the fragmented masses of spent in situ oil shale retorts for increasing the compressive strength of the spent in situ retorts. Grout can be introduced by drilling through the fragmented mass, placing a perforated casing (not shown), and injecting a grout through such a perforated casing.

After the fragmented masses in the rows of retorts are stabilized, they are capable of supporting a substantial portion of the weight of the overburden. A second group of in situ oil shale retorts 40 are then formed in parallel rows 42, 44, etc., in the intervening zones of unfragmented formation interleaved between the rows 16, 18, 20, etc., of spent in situ retorts 38. As is shown best in FIG. 3, the intervening retorts 40 are rectangular in shape, are similar to the retorts 12 in the first group, and are equidistantly spaced apart from one another along the length of each row. This leaves spearate partitions or gas barriers of unfragmented formation 42 between the ends of adjacent retorts in each row of intervening retorts. The intervening retorts are arranged so that their long dimensions are aligned generally parallel to the length of each row, with their short dimensions being substantially perpendicular to the length of each row. The rows of intervening retorts are preferably centered along each intervening zone of unfragmented formation, leaving partitions or barrier pillars 44 of unfragmented formation between the new formed intervening retorts and the spent in situ retorts 38 in adjacent rows. The intervening retorts are rectangular and have dimensions similar to the retorts 12 in the first group. Thus, for example, the intervening retorts also can be about 165 feet wide, about 380 feet long, and about 300 to 400 feet in height. The partitions of unfragmented formation 42 between the ends of the intervening retorts are about 50 feet thick, and the barrier pillars of unfragmented formation 44 that separate opposite sides of the intervening retorts from adjacent rows of spent in situ retorts are about 50 feet thick.

Thus, each newly formed intervening retort is essentially surrounded by a barrier of unfragmented formation. The vertically extending partitions 42 of unfragmented formation between the ends of the intervening retorts provide gas barriers for isolating retorting operations in the intervening retorts 40 within each row from one another. The vertically extending barrier pillars 44 of unfragmented formation on opposite sides of each intervening retort provide gas barriers for isolating retorting operations in the intervening retorts from the spent in situ retorts on opposite sides of each intervening retort. Rather than forming the intervening retorts so they are contiguous with the side boundaries of the spent in situ retorts, it is more desirable to form the rows of intervening retorts so they are spaced apart from the spent in situ retorts by the barriers of unfragmented formation 44 on opposite sides of the intervening retorts. If the intervening retorts are stacked together between the spent retorts as close as possible, retorting operations in the intervening retorts are not sufficiently isolated from adjacent spent in situ retorts. The fragmented masses of spent in situ retort particles, even though they contain a stabilizing material, do not provide the necessary impermability to gas flow provided by unfragmented formation in the gas barriers 42, 44, that surround each intervening in situ retort.

In addition, the barriers of unfragmented formation that surround the intervening retorts provide added stabilization for overburden loads with the stabilization provided by the stabilized spent in situ retorts. The retorts in the intervening rows are arranged with respect to the spent in situ retorts in adjacent rows such that the barrier pillars 44 of unfragmented formation adjacent opposite sides of the intervening retorts form long, continuous pillars for supporting overburden loads; and the partitions 42 of unfragmented formation between the ends of the retorts in each intervening row are continuous with the partitions 22 in adjacent rows of spent in situ retorts to form long, continuous pillars of unfragmented formation for supporting overburden loads. This results in a grid-work of load supporing pillars of unfragmented formation around the stabilized spent in situ retorts and the fragmented masses in the intervening in situ retorts. Formation of the rows of intervening retorts shifts the overburden suport so that the overburden support is provided, in part, by the grid-work of pillars of unfragmented formation and, in part, by the stabilized fragmented masses in the spent in situ retorts. Some of the overburden weight can also be supported by the fragmented masses in the rows of intervening retorts. The fragmented masses in each row of intervening retorts are sufficiently small in width such that no substantial load is applied to the fragmented masses in the intervening row of retorts, which avoids undesired subsidence or rupture of overburden above the intervening retorts; and collectively, the support for overburden is enhanced by the grid-work of pillars and the stabilized spent in situ retorts so that no substantial subsidence occurs at elevations above the top boundaries of the retorts during the operating lift of the intervening retorts.

Subsidence is a time-dependent phenomenon, as well, and such an arrangement of retorts can provide sufficient support for overburden that subsidence is limited during the effective operating lift of the retorts. After the operating life of the intervening rows of retorts, nominal subsidence of overburden can be tolerated.

What is claimed is:

1. A method for inhibiting uncontrolled subsidence of overburden and for recovering liquid and gaseous products from a group of in situ oil shale retorts formed in a subterranean formation containing oil shale, the method comprising the steps of:

forming a first row of in situ oil shale retorts, each retort in such a first row containing a fragmented permeable mass of formation particles containing oil shale, leaving gas barriers of unfragmented formation between adjacent retorts in such a first row;

forming a second row of in situ oil shale retorts, each retort in such a second row containing a fragmented permeable mass of formation particles containing oil shale, leaving gas barriers of unfragmented formation between adjacent retorts in such a second row;

leaving an intervening zone of unfragmented formation between the first and second rows of retorts for forming a gas barrier between in situ retorts in the first row and in situ retorts in the second row, the intervening zone of unfragmented formation and the gas barriers of unfragmented formation between in situ retorts in the first and second rows collectively providing support for overburden above the first and second rows of in situ retorts without substantial subsidence of overburden during the operating lift of retorts in such first and second rows;

retorting the fragmented masses within such first and second rows of retorts for producing liquid and gaseous products of retorting the retorts in the first and second rows being left as spent in situ retorts containing a fragmented permeable mass of spent oil shale particles;

introducing stabilizing material into void spaces in the spent in situ retorts in such a first row and such a second row of spent retorts for forming first and second rows of stabilized spent in situ retorts in which the compressive strength of such a stabilized spent in situ retort is increased by the stabilizing material;

forming a row of spaced apart intervening in situ oil shale retorts in the intervening zone of unfragmented formation between the first and second rows of stabilized spent in situ retorts, each intervening retort containing a fragmented permeable mass of formation particles containing oil shale; leaving gas barriers of unfragmented formation between adjacent retorts in such a row of intervening in situ retorts; and leaving intervening barrier pillars of unfragmented formation between the row of intervening retorts and adjacent rows of stabilized retorts in the first and second rows on opposite sides of such an intervening retort for inhibiting gas flow between such an intervening retort and the stabilized retorts in the first and second rows, the stabilized retorts combining with the gas barriers of unfragmented formation between the intervening retorts and the intervening barrier pillars of unfragmented formation for providing support for overburden above the row of intervening retorts without substantial subsidence of overburden during the operating life of such an intervening retort; and retorting the fragmented masses within the intervening retorts for producing liquid and gaseous products of retorting.

2. The method according to claim 1 wherein each retort comprising the first and second rows of retorts has a rectangular shape with the long dimension of each such retort being generally parallel to the length of the first and second rows.

3. The method according to claim 1 including arranging the retorts in the first and second rows so the width of such retorts is sufficiently small that no substantial load is applied by overburden to fragmented masses in such retorts.

4. The method according to claim 1 including arranging the retorts in the first and second rows and in the intervening row so that the width of such retorts in each row is sufficiently small to inhibit rupture of overburden above such retorts.

5. A method for recovering liquid and gaseous products from a group of in situ oil shale retorts formed in a subterranean formation containing oil shale, in which an intervening zone of unfragmented formation is left between a first row of mutually spaced apart spent in situ oil shale retorts and a second row of mutually spaced apart spent in situ oil shale retorts, such a spent in situ oil shale retort containing a fragmented permeable mass of spent oil shale particles, the method comprising the steps of:

introducing a stabilizing material into void spaces between the spent oil shale particles in such a first row and such a second row of spent retorts for forming first and second rows of stabilized spent in situ retorts in which the compressive strength of such a stabilized retort is increased by the stabilizing material;

forming a row of mutually spaced apart intervening in situ oil shale retorts in the intervening zone of unfragmented formation, such an intervening retort containing a fragmented permeable mass of formation particles containing oil shale;

leaving gas barriers of unfragmented formation between adjacent retorts in such a row of intervening retorts for inhibiting gas flow between adjacent intervening retorts;

leaving a first barrier pillar of unfragmented formation between the row of intervening retorts and the first row of stabilized retorts;

leaving a second barrier pillar of unfragmented formation between the row of intervening retorts and the second row of stabilized retorts; and retorting the intervening retorts for producing liquid and gaseous products of retorting, the stabilized retorts combining with the gas barriers between adjacent intervening retorts and the first and second barrier pillars for providing support for overburden loads above the row of intervening retorts without substantial subsidence of overburden during the active lift of the intervening retorts.

6. The method according to claim 5 wherein each such intervening retort has a rectangular shape with the long dimension of each intervening retort being generally parallel to the length of the row of intervening retorts.

7. The method according to claim 5 including arranging the intervening retorts so the width of such retorts is sufficiently small to avoid rupture of overburden above the row of intervening retorts.

8. A method for controlling subsidence of overburden and for recovering liquid and gaseous products from a system of in situ oil shale retorts, such an in situ oil shale retort containing a fragmented permeable mass of formation particles containing oil shale, in which an intervening zone of unfragmented formation is left between at least one first spent in situ oil shale retort and at least one second spent in situ oil shale retort in which retorting operations have previously been conducted, such a spent in situ retort containing a fragmented permeable mass of spent oil shale particles, the method comprising the steps of:

introducing stabilizing material into void spaces in such first and second spent in situ retorts for increasing the average compression strength of such spent in situ retorts;

forming at least one intervening in situ oil shale retort in the intervening zone of unfragmented formation, such an intervening retort containing a fragmented permeable mass of formation particles containing oil shale;

leaving a substantially vertical barrier pillar of unfragmented formation surrounding the intervening retort, the vertical barrier pillar of unfragmented formation being of sufficient thickness to inhibit gas flow from the intervening retort to the first and second spent retorts; and retorting such an intervening in situ retort for producing liquid and gaseous products, the barrier pillar combining with the first and second spent in situ retorts providing support for overburden above such an intervening retort without substantial uncontrolled subsidence of overburden during the operating life of such an intervening retort.

9. The method according to claim 8 including arranging the intervening retort so that one of its side boundaries is adjacent such a first spent in situ retort and an opposite side boundary of the intervening retort is adjacent such a second spent in situ retort.

10. The method according to claim 8 including arranging such an intervening retort so that its width is sufficiently small to avoid rupture of overburden during the operating life of such an intervening retort.

11. A method for recovering liquid and gaseous products from a group of in situ oil shale retorts formed in a subterranean formation containing oil shale, in which an intervening zone of unfragmented formation is left between a first row of mutually spaced apart spent in situ oil shale retorts and a second row of mutually spaced apart spent in situ oil shale retorts in which retorting operations have previously been conducted, such a spent in situ oil shale retort containing a fragmented permeable mass of spent oil shale particles, the retorts in the first and second rows being sufficiently small in width that no substantial load is applied by overburden to the fragmented masses of retorts in such first and second rows, the method comprising the steps of:

introducing a stabilizing material into void spaces between the spent oil shale particles in such first and second rows of spent in situ retorts for forming first and second rows of stabilized spent in situ retorts in which the compressive strength of such a spent in situ retort is increased by the stabilizing material;

forming a row of spaced apart intervening in situ oil shale retorts in the intervening zone of unfragmented formation, such an intervening in situ oil shale retort containing a fragmented permeable mass of formation particles containing oil shale, the intervening retorts being sufficiently small in width that no substantial load is applied by overburden to fragmented masses within such a row of intervening retorts;

leaving separate gas barriers of unfragmented formation between adjacent pairs of intervening in situ retorts;

leaving a first load-supporting barrier pillar of unfragmented formation between the row of intervening retorts and the first row of stabilized spent retorts for inhibiting gas flow between the row of intervening retorts and the first row of stabilized spent retorts;

leaving a second load-supporting barrier pillar of unfragmented formation between the row of intervening retorts and the second row of stabilized spent retorts for inhibiting gas flow between the row of intervening retorts and the second row of stabilized spent retorts; and retorting the fragmented mases in the row of intervening retorts for producing liquid and gaseous products, the stabilized spent retorts in the first and second rows combining with the first and second load-supporting barrier pillars of unfragmented formation and the gas barriers between such intervening retorts for supporting overburden above the top boundaries of the row of intervening retorts without substantial subsidence during the operating life of the intervening retorts.

12. The method according to claim 11 including leaving first gas barriers of unfragmented formation between adjacent in situ retorts in the first row and leaving second gas barriers of unfragmented formation between adjacent in situ retorts in the second row; and including arranging the intervening in situ retorts so that the gas barriers of unfragmented formation left between adjacent intervening in situ retorts are continuous with the first and second gas barriers of unfragmented formation in adjacent rows for forming straight pillars of unfragmented formation that intersect the first row of spent in situ retorts, the row of intervening in situ retorts, and the second row of spent in situ retorts.

13. The method according to claim 12 including arranging the first and second load-supporting barrier pillars of unfragmented formation so they extend generally parallel to one another and intersect said straight pillars of unfragmented formation for forming a gridwork of load-supporting barriers of unfragmented formation that surround one or more stabilized spent rotorts in the first row, one or more intervening retorts, and one or more stabilized spent retorts in the second row.

14. The method according to claim 11 in which the first and second load-supporting barrier pillars combine with the gas barriers adjacent opposite ends of such an intervening in situ oil shale retort to surround the intervening retort with a barrier of unfragmented formation.

15. In a two-pass retorting system for developing an oil shale tract in which a first pass has resulted in spaced apart rows of spent in situ oil shale retorts, such rows being separated by an intervening zone of unfragmented formation, such a spent in situ oil shale retort containing a fragmented permeable mass of spent oil shale particles, a method for forming a system of in situ oil shale retorts in a second pass so that subsidence of overburden is inhibited during the second pass, the method comprising the steps of:

introducing a stabilizing material into void spaces between spent oil shale particles within the spent in situ retorts for increasing the compressive strength of the spent in situ retorts to provide spaced apart rows of stabilized spent in situ retorts;

forming a row of mutually spaced apart intervening in situ oil shale retorts between adjacent rows of stabilized spent in situ retorts, such an intervening in situ oil shale retort containing a fragmented permeable mass of formation particles containing oil shale;

leaving separate gas barriers of unfragmented formation between adjacent intervening in situ retorts;

leaving first and second load-supporting barrier pillars of unfragmented formation on opposite sides of the row of intervening in situ retorts for separating the row of intervening retorts from adjacent rows of stabilized spent in situ retorts, the width of the row of intervening in situ retorts being sufficiently narrow, when combined with the compressive strength of the adjacent rows of stabilized spent in situ retorts and the first and second load-supporting pillars of unfragmented formation, for inhibiting rupture of overburden above the row of intervening in situ oil shale retorts during the operating life of the intervening retorts; and retorting the intervening retorts for producing liquid and gaseous products of retorting.

* * * * *